US007175308B1

(12) United States Patent
Lin

(10) Patent No.: US 7,175,308 B1
(45) **Date of Patent: *Feb. 13, 2007**

(54) STRUCTURE OF COMBINED DUAL SOCKETS CHRISTMAS LIGHT

(76) Inventor: Mei-Lu Lin, P.O. Box 697, Fongyuan City, Taichung County (TW) 420

( * ) Notice: Subject to any disclaimer, the term of this patent is extended or adjusted under 35 U.S.C. 154(b) by 0 days.

This patent is subject to a terminal disclaimer.

(21) Appl. No.: 10/912,202

(22) Filed: Aug. 6, 2004

(51) Int. Cl.
*F21S 13/14* (2006.01)

(52) U.S. Cl. ..... 362/252; 362/227; 362/238; 362/654; 362/249; 362/806; 362/211

(58) Field of Classification Search ..... 362/211, 362/227, 238, 252, 654, 659; 439/699.2, 439/507, 510, 511
See application file for complete search history.

(56) References Cited

U.S. PATENT DOCUMENTS 5,913,597 A * 6/1999 Lin ..... 362/653
5,938,314 A * 8/1999 Lin ..... 362/249
6,367,952 B1 * 4/2002 Gibboney, Jr. ..... 362/249
6,382,813 B1 * 5/2002 Huang ..... 362/249
6,966,670 B1 * 11/2005 Lin ..... 362/227

* cited by examiner

*Primary Examiner*—Renee Luebke
*Assistant Examiner*—Zahra I Bennett

(57) ABSTRACT

A structure of combined sockets of Christmas light includes a pair of first and second sockets integrated together to form a stepped configuration each having a single inlaid groove for engaging a single contact plate, a common slit connecting a common inlaid groove between the sockets for engaging a common contact plate, a pair of corkers blocking the bottom of the sockets each having a through hole for passing through the electric wires, a pair of hooks each facing a hindering plate on the opposing upper peripheries of the second socket, two lamps engaged within the upper rim of the sockets respectively each having a pair of lead-in wires respectively engaged with the common contact plate and the contact plates wherein the second lamp further has a pair of L-shaped blocking members respectively engaged within a pair of gaps between the hocks and the hindering plates.

2 Claims, 7 Drawing Sheets

(3-3)

(3'-3')

STRUCTURE OF COMBINED DUAL SOCKETS CHRISTMAS LIGHT

BACKGROUND OF THE INVENTION

The present invention relates to Christmas lights and more particularly to a structure of combined dual sockets Christmas light.

Previously, the applicant has disclosed a lot of combined sockets of Christmas lights which includes the stepped shape, the twins shape and/or the multi-combined shaped in which the common contact copper plate must enter into the sockets from the upper rim of the sockets and causes difficulty to assemble during the manufacturing stage. A small error of the engagement to its correct position, sometimes brings about the disconnection of electric current. Thus, not only wastes time and labor but also increases the defective fraction. Further, each socket requires an electric wire and a copper plate. The electric wire has no any positioning structure. So that the electric wire is easily to break off from its copper plate when the user draws the string of Christmas light during the decoration stage, therefore damaging the whole string of Christmas light. Besides, the upper rim of the socket must have an indenture to facilitate the insertion of the common contact plate into the socket. This arrangement may favor the moisture or water penetrating into the socket and may cause an electric shake. Anyhow, a combined dual sockets must deliberate upon the proper placement of the common contact plate in order to avoid a disconnection of the electric current.

SUMMARY OF THE PRESENT INVENTION

The present invention has a main object to provide a structure of combined dual sockets Christmas light in which a common contact plate is inserted into the sockets upward from their underside so as to ensure the plate to be stable and has a good conductivity.

Another object of the present invention is to provide a structure of combined dual sockets Christmas light which has a choker blocking the bottom of the socket providing a double-function of preventing both the electric wire from breaking off the contact plate and the common contact plate from loosening up.

Further object of the present invention is to provide a structure of combined dual sockets Christmas light in which the upper rim of the sockets leave no any indenture to the moisture or water.

Accordingly, the structure of combined dual socket Christmas light comprises at least a first and a second sockets combined together each having an upper rim and an opened bottom with the upper rim of the second socket positioned at the middle periphery of the first socket. The sockets each has an inlaid groove in an inner periphery for engaging with a contact plate from an electric wire and a common inlaid groove together with a common slit formed between the two socket for engaging within a common contact plate. A pair of chokers respectively black the opened bottom of the sockets to prevent the electric wires from breaking off their contact plates and the common contact plate from loosening up. A pair of lamps respectively inserted into the upper rim of the socket each having pair of lead-in wires attached on the bottom and respectively engaged with the common contact plate and the contact plates from the electric wires.

The present invention will become more fully understood by reference to the following detailed description thereof when read in conjunction with the attached drawings.

DETAILED DESCRIPTION OF THE PREFERRED EMBODIMENT

Figure 1:
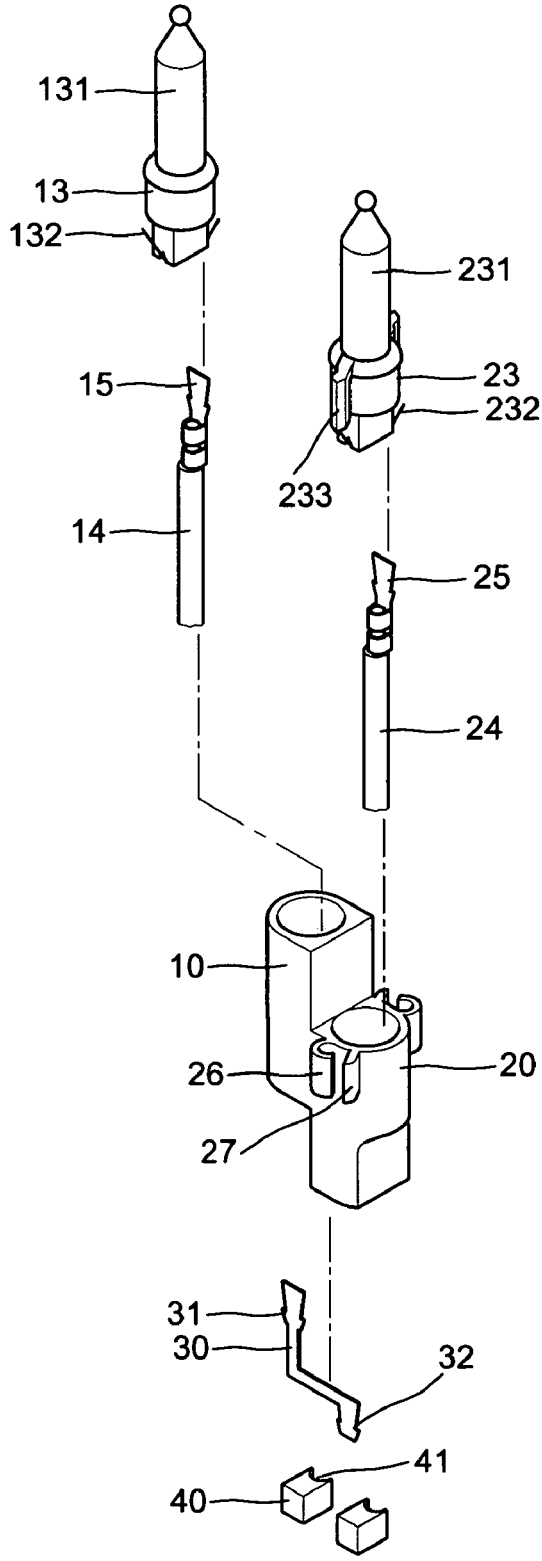
FIG. 1 is an exploded perspective of the preferred embodiment of the present invention.
Figure 2:
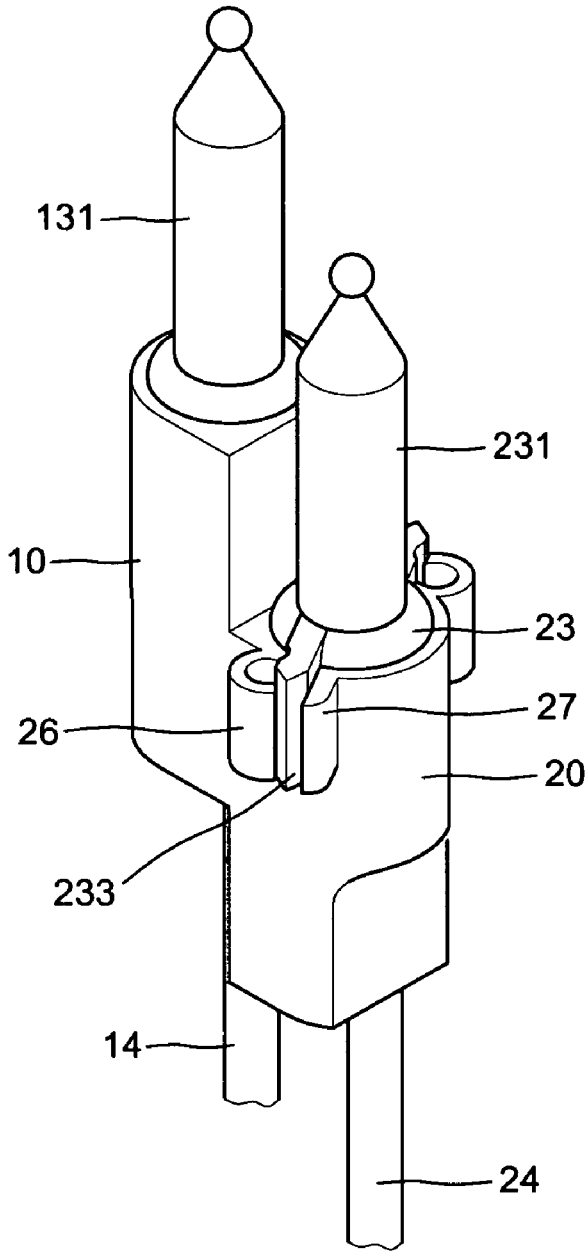
FIG. 2 is a perspective view to show the assembly of FIG. 1.
Figure 3:
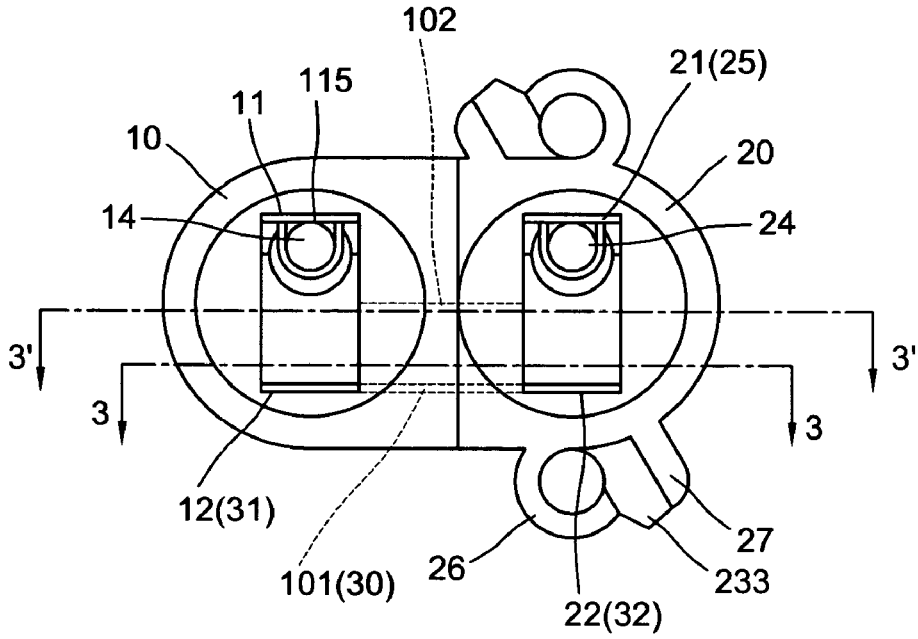
FIG. 3 is a top plane view of FIG. 2.
Figure 4:
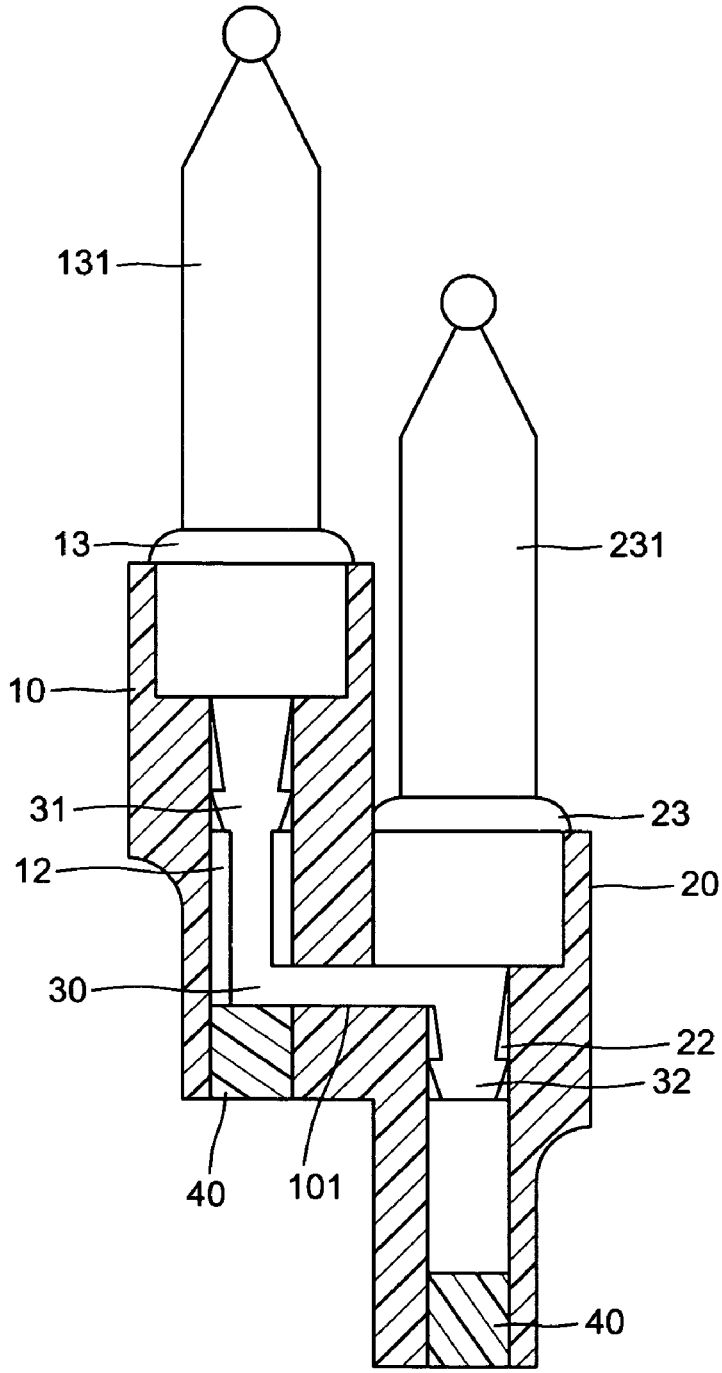
FIG. 4 is a sectional view indicating the position and the bent common contact plate, taken along line 3—3 of FIG. 3.
Figure 5:
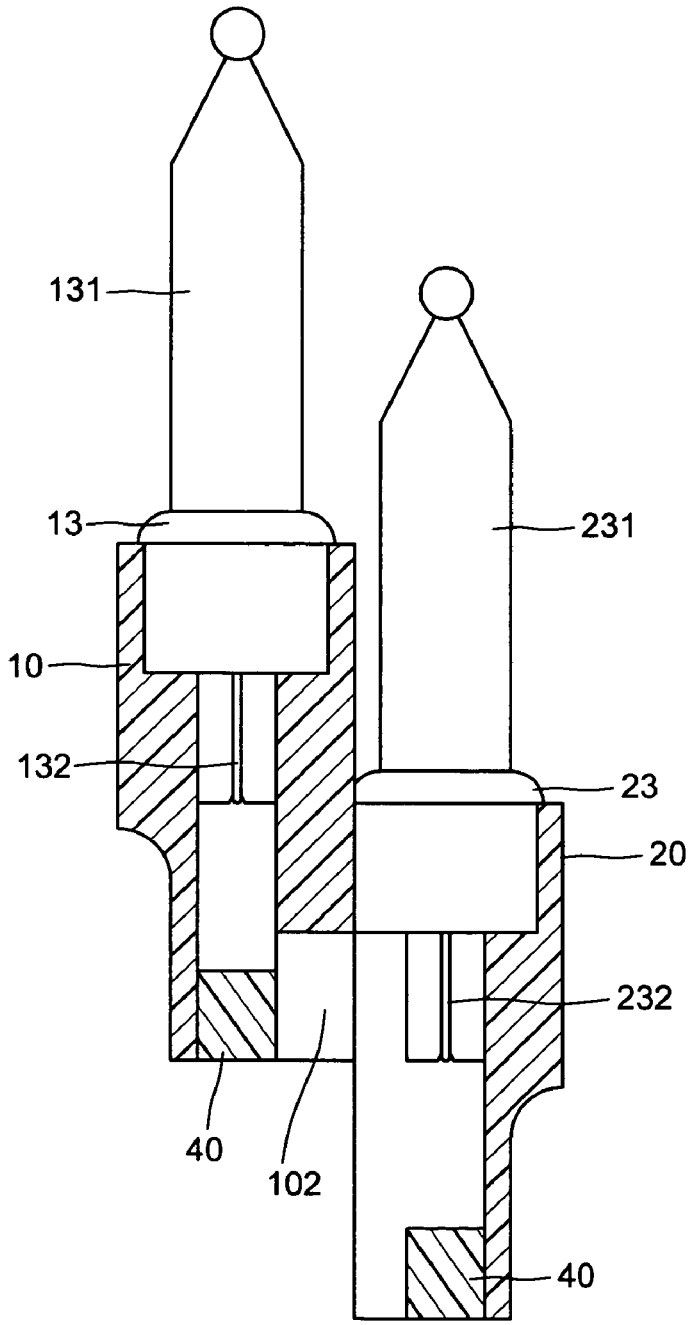
FIG. 5 is a sectional view taken along line 3'—3' of FIG. 3.
Figure 6:
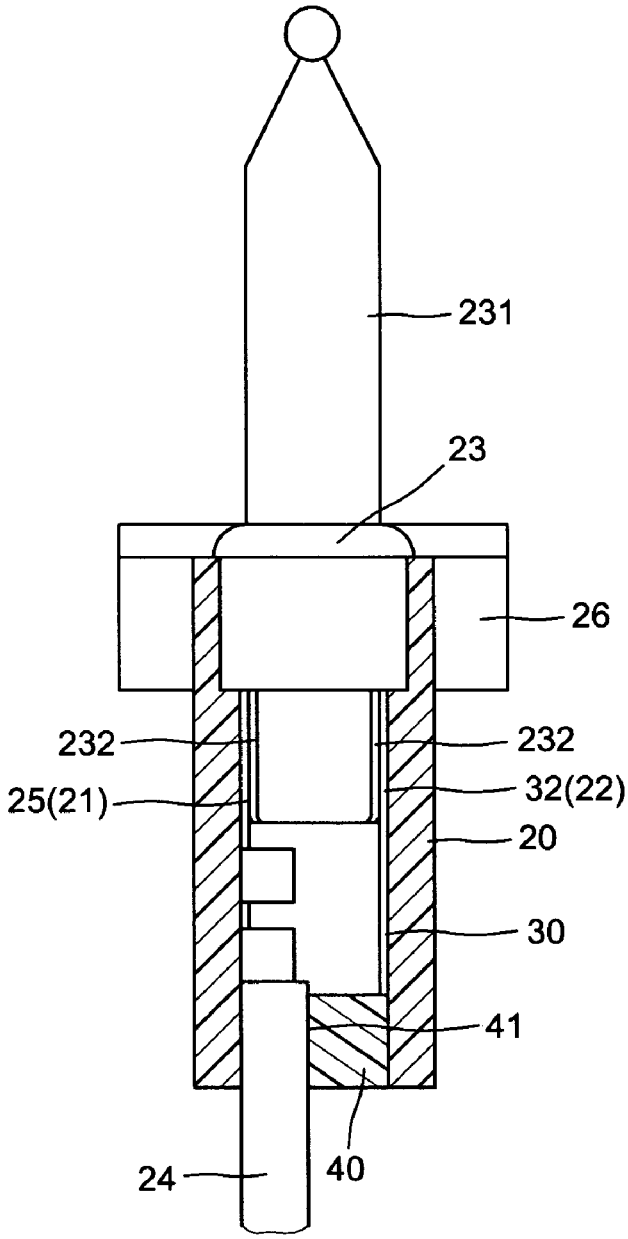
FIG. 6 is a sectional view to show an assembly of the second socket.

With reference to FIGS. 1, 2 and 3 of the drawings, the structure of combined dual sockets Christmas light comprises at least a first socket 10 combined with second socket 20 each having an upper rim and an opened bottom with the upper rim of the second socket 20 positioned at a middle outer periphery of the first socket 10. So that they are combined as a stepped configuration. The first socket 10 has an inlaid groove 11 in an inner periphery symmetrical another inlaid groove 12. Meanwhile, the second socket has also an inlaid groove 21 in an inner periphery symmetrical to another inlaid groove 22 (as shown in FIG. 3), a transverse groove connects the inlaid grooves 12 and 22 to form a two bends common inlaid groove 101 therebetween and a common slit 102 centrally formed between the two sockets 10 and 20 for facilitating the insertion of a two bends common contact plate 30 into the common inlaid groove 101. The bent common contact plate 30 has two stop ends 31 and 32 respectively disposed in the inlaid grooves 12 and 22 of the sockets 10 and 20 (as shown in FIGS. 3, 4 and 5). A pair of corkers 40 respectively block the opened bottom of the sockets 10 and 20 each has a through hole 41 for respectively permitting the electric wires 14 and 24 passing through (as shown in FIG. 6). The electric wires each connects a contact plate 15 and 25 which are respectively engaged within the inlaid grooves 11 and 21 of the sockets 10 and 20. The corkers 40 has dual functions to present the electric wire 14 and 24 from breaking off its contact plates 15 and 25 and the common contact plate 30 from loosened up. A pair of the lamps 13 and 23 respectively inserted into the upper rims of the sockets 10 and 20 each has a base, a bulb 131 and 231 and a pair of lead-in wires 132 and 232 respectively engaged with the contact plates 15 and 25 and the common contact plate 30, wherein the lamp 23 further has a pair of L-shaped blocking members 233 on opposite periphery of the base respectively blocking the gaps between pair of hooks 26 and a pair of hindering plates 27 which are symmetrically form on the opposing upper peripheries of the second socket 20.

Due to that the common contact plate 30 is inserted upward into the common slit 102 between the first and second sockets 10 and 20 and then displaced into the common inlaid groove 101 and the two corkers 40 block the opened bottom of the sockets 10 and 20, the common contact plate 30 for its bent structure will be stably disposed in the common inlaid grooves 101 which facilitates the lead-in wires 132 and 232, a perfect engagement with the contact plats 15, 25 and 30 without disconnecting the electric current.

Further the upper rims of the sockets 10 and 20 have no any indentures and firmly blocked by the bases of the lamps 13 and 23, the moisture or water has no way to penetrate into the sockets 10 and 20 so that there is no danger of electric shacks but more safe. Except that the electric wires 14 and 24 will not break off, the pair of hooks 26 are provided to hold the outside electric wires 14 and 24 and the non-conductive cord when reticulates the Christmas light into a network.

Figure 7:
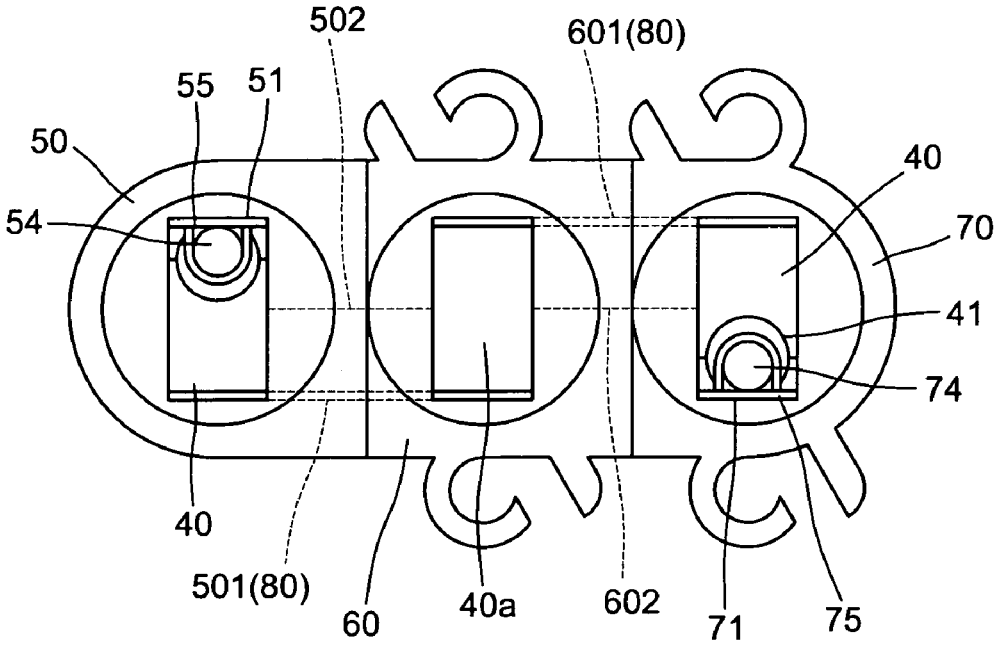
FIG. 7 is a plane view of an alternate embodiment looking from underside.

Referring to FIG. 7, an alternate embodiment of the present invention is provided. This embodiment comprises three sockets 50, 60 and 70 combined together into an alignment of stepped configuration.

A common slit 502 and a common inlaid groove 501 formed between the sockets 50 and 60 and a common slit 602 and a common inlaid groove 601 formed between the sockets 60 and 70, an electric wire 54 with a contact plate 55 disposed into the inlaid groove 51, and another electric wire 74 with a contact plate 75 disposed into the inlaid groove 71 of the socket 70. Then a common contact plate 80 respectively disposed into the inlaid grooves 501 and 601 for the connecting of the electric current. A pair of corkers 40 respectively block the open bottom of the sockets 50 and 70 and a corker 40*a* blocks the opened bottom of the socket 60, wherein the corker 40*a* has no though hole 41. Other structure and function are equal to that of the above embodiment.

Actually, the number of the combined sockets is incremental and the corker 40 may be individual and/or combined a number of the corkers together in order to simultaneously block an alignment of the combined sockets.

Note that the specification relating to the above embodiment should be construed as an exemplary rather than as a limitative of the present invention, with many variations and modifications being readily attainable by a person of average skill in the art without departing from the spirit or scope thereof as defined by the appended claims and their legal equivalents.

I claim:

1. A structure of combined socket of Christmas light comprising:

a pair of first and second sockets integrated together and each having an upper rim and a opened bottom, wherein the upper rim of said second socket being positioned at a middle periphery of said first socket to form a stepped configuration, a pair of hooks symmetrically formed on opposing outer peripheries of said second socket abutting the upper rim thereof each including a hindering plate facing an opening of said hooks to defined a gap therebetween, said sockets each having a single inlaid groove in an inner periphery and a common inlaid groove which are connected by a transverse groove and a common slit formed between lower portion of said sockets and communicating with said common groove;

a two bends common contact plate inserted upward into said common inlaid groove via said slit and having a pair of stopped ends respectively engaged with said first and second grooves;

a pair of electric wires which may be held by said hooks each connecting a contact plate inserted into the opened bottom of said sockets and engaged within said single inlaid grooves respectively;

a pair of corkers respectively blocking the opened bottom of said sockets and each having a through hole for permitting said electric wires passing through;

a pair of first and second lamps respectively engaged into the upper rim of said sockets each having a base, a bulb and a pair of lead-in wires attached to lateral sides of said base and respectively engaged with said common contact plate and the contact plates of said electric wires, wherein said second lamp further having a pair of L-shaped blocking member on opposing outer peripheries of said base for blocking the gaps between said hooks and said hindering plates.

2. A structure of combined sockets of Christmas light comprising:

a first, second and third sockets combined into an alignment of stepped configuration, a first common slit and a first common inlaid groove formed between said first and second sockets, and second common slit and a second common inlaid groove formed between said second and third sockets for respectively engaging within a pair of common contact plates, a single inlaid groove formed in said first and third sockets opposite to said common inlaid groove for respectively engaging with a contact plate of a pair of electric wires, a pair of first corkers respectively blocking an opened bottom of said first and third sockets each having a through hole for permitting said electric wires passing through, a second corker which is solid blocking an opened bottom of said second socket, said second and third sockets each having a pair of hooks facing a pair of hindering plates formed on their opposing outer peripheries each defining a gap therebetween, a first, second and third lamps respectively engaged into an upper rim of said first, second and third sockets and each having a base, a bulb and pair of lead-in wires attached to lateral sides of said bases and respectively engaged with said common contact plates and said contact plates of said electric wires which may be held by said hooks, wherein said second and third lamps each having a pair of L-shaped blocking members on opposing outer peripheries of said base respectively blocking the gaps between said hooks and said hindering plates.

* * * * *